US005179257A

United States Patent [19]

Dufournet et al.

[11] Patent Number: 5,179,257

[45] Date of Patent: Jan. 12, 1993

[54] MEDIUM-VOLTAGE GAS CIRCUIT-BREAKER

[75] Inventors: Denis Dufournet, Bron; Michel Perret, Bourgoin-Jallieu, both of France

[73] Assignee: GEC Alsthom SA, Paris, France

[21] Appl. No.: 569,056

[22] Filed: Aug. 17, 1990

[30] Foreign Application Priority Data

Aug. 18, 1989 [FR] France ..... 89 11018

[51] Int. Cl.[5] ..... H01N 33/82; H01N 33/88

[52] U.S. Cl. ..... 200/148 A

[58] Field of Search ..... 200/148 R, 148 A, 148 B, 200/148 E, 148 H, 148 BV, 148 F, 149 A, 150 G

[56] References Cited

U.S. PATENT DOCUMENTS 4,327,263 4/1982 Sakurai et al. ..... 200/148 A
4,471,188 9/1984 Van et al. ..... 200/148 A
4,517,425 5/1985 Martin ..... 200/148 A

FOREIGN PATENT DOCUMENTS 0033355 8/1981 European Pat. Off. .
0315505 5/1989 European Pat. Off. .
1171974 6/1964 Fed. Rep. of Germany .
3727802 3/1989 Fed. Rep. of Germany .

*Primary Examiner*—Sharon D. Logan
*Assistant Examiner*—Michael A. Friedhofer
*Attorney, Agent, or Firm*—Sughrue, Mion, Zinn, Macpeak & Seas

[57] ABSTRACT

A medium-voltage circuit-breaker comprises a sealed enclosure filled with a dielectric gas and containing a semi-fixed first contact electrically connected to a first terminal and a mobile second contact electrically connected to a second terminal and mechanically coupled to an operating member. The semi-fixed contact is associated with a piston moving in a first cylinder constituting a first volume and provided at one end with a nozzle in which the mobile contact can be inserted when the circuit-breaker is in the engaged (on) position. The piston is acted on by a spring urging it in the direction in which the first volume decreases. The circuit-breaker comprises a system for causing the gas to circulate automatically between the first volume and a second volume when the current to be interrupted reaches a predetermined threshold value. The semi-fixed contact is a tube communicating with a third volume consisting of the remainder of the enclosure.

11 Claims, 9 Drawing Sheets

MEDIUM-VOLTAGE GAS CIRCUIT-BREAKER

BACKGROUND OF THE INVENTION

1. Field of the Invention

The present invention concerns a medium-voltage circuit-breaker in which insulation is provided by a gas with good dielectric properties such as sulfur hexafluoride (SF6), this gas also extinguishing the arc which forms when the arc contacts of the switch move apart.

2. Description of the Prior Art

This type of circuit-breaker includes an interrupter chamber which contains the arc contacts, and the gas in which is heated by the arc when these contacts separate with the result that the gas pressure is increased. The gas expands and extinguishes the arc at the first zero current crossing.

Problems are encountered with such equipment:

When low currents are interrupted (for example, currents less than or equal to the nominal current in the circuit in which the circuit-breaker is incorporated) the pressure increase may be insufficient or excessive, depending on the dimensions of the interrupter chamber. If the chamber is large, the pressure increase is small and the extinction effect may be insufficient; if the chamber is small the pressure rise is high but the extinction time may be insufficient to be properly effective.

When high currents (short-circuit currents, for example) are interrupted the pressure increase must not be too large, as this could risk damage to the interrupter chamber.

One proposal to overcome these problems (see in particular the documents DE - A - 3 727 802 and EP - A - 0 315 505) is to provide an interrupter chamber whose volume is variable according to the current to be interrupted. This is achieved by replacing the fixed contact usually found in the circuit-breaker with a semi-fixed contact coupled to a spring-loaded piston. The displacement of the piston varies according to the current to be interrupted and the interrupter chamber is correspondingly larger or smaller. To be more precise, the interrupter chamber volume remains constant for low currents; if the current reaches a particular threshold, an additional volume is added; for medium currents to be interrupted the interrupter chamber volume is increased by displacement of the piston against the spring In devices of this kind the gas is polluted by the arc, which is prejudicial to effective extinction.

One aim of the present invention is to provide a circuit-breaker which does not suffer from this disadvantage and which, when a higher current threshold is reached, allows circulation of the gas in such a way as to improve the regeneration of its dielectric properties and to enable extinction at each root of the arc.

SUMMARY OF THE INVENTION

The invention consists in a medium-voltage circuit-breaker comprising a sealed enclosure filled with a dielectric gas and containing a semi-fixed first contact electrically connected to a first terminal and a mobile second contact electrically connected to a second terminal and mechanically coupled to an operating member, said semi-fixed contact being associated with a piston moving in a first cylinder constituting a first volume and provided at one end with a nozzle in which the mobile contact can be inserted when the circuit-breaker is in the engaged (on) position, said piston being acted on by a spring urging the piston in the direction in which said first volume decreases, the circuit-breaker comprising means for causing the gas to circulate automatically between said first volume and a second volume when the current to be interrupted reaches a predetermined threshold value, said semi-fixed contact being a tube communicating with a third volume consisting of the remainder of the enclosure.

In one embodiment of the invention said gas circulation means comprise a series of openings in said first cylinder discharging into said second volume, the latter communicating with the interior of the nozzle.

In another embodiment said gas circulation means comprise valves disposed in said first cylinder and discharging into the second volume, said valves opening only if the pressure in the first cylinder reaches a predetermined threshold.

In a further embodiment said gas circulation means comprise a jacket separating said first and second volumes, said jacket being able to move against a spring if the pressure in said first volume reaches said threshold.

The invention will be better understood from the following description of various embodiments of the invention with reference to the drawings.

DETAILED DESCRIPTION OF THE INVENTION

Figure 1:
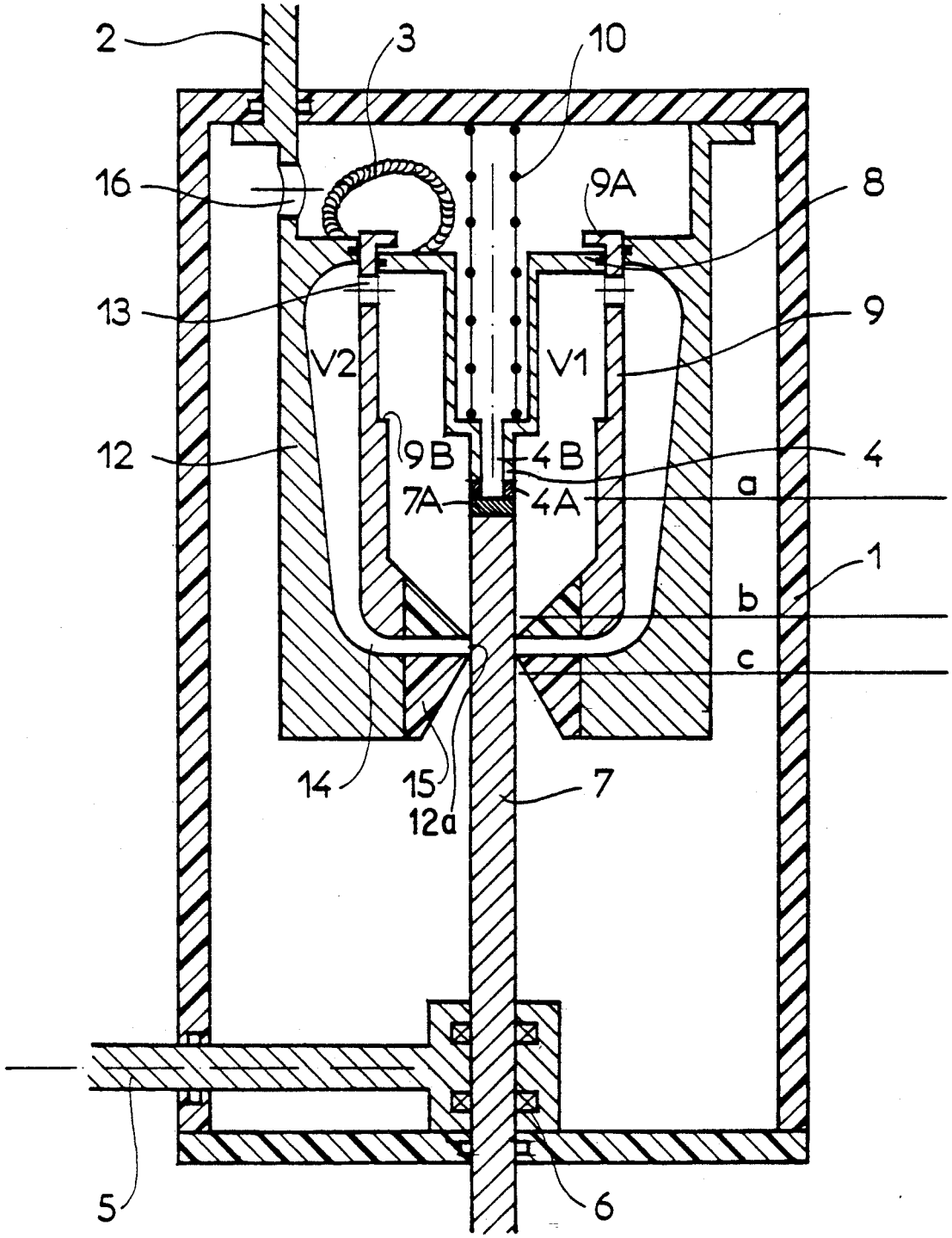
FIG. 1 is a partial schematic view in axial cross-section of a first embodiment of circuit-breaker.

FIG. 1 shows an insulative material enclosure 1 containing a gas with good dielectric properties such as sulfur hexafluoride SF6 at a pressure of a few bars. A first terminal 2 passes through the enclosure, to which it is sealed. It is electrically connected by a braid 3 to a first contact 4 called the semi-fixed contact for reasons to be explained later. The contact 4 has at the end a wear-away part 4A made from a material which is resistant to the effects of the electrical arc, such as a tungsten-based alloy, for example.

A second terminal 5 passes through the enclosure 1, to which it is sealed. It is electrically connected through sliding contacts 6 to a rod 7 constituting a moving or mobile contact of the circuit-breaker; the rod 7 passes through the enclosure, to which it is sealed. It is coupled to an operating mechanism (not shown). The rod 7 has an end part 7A made from a material resistant to the effects of the electric arc.

The semi-fixed contact 4 is fixed to a piston 8 sliding in a fixed cylinder 9 delimiting a first volume V1; upward travel of the piston 8 is limited by a ring 9A and downward travel by a shoulder 9B on the cylinder 9. The contact 4 is pushed in the downward direction by a spring 10 which is compressed when the circuit-breaker is in the engaged (on) position, as is the case in FIG. 1.

The cylinder 9 is inside a larger cylinder 12; V2 denotes the volume between the cylinders 9 and 12. The volumes V1 and V2 communicate through openings 13 in the upper part of the walls of the cylinder 9. The cylinders 9 and 12 are closed at the lower end to define axial passages 14 passing through a nozzle 15 having an axial bore 12*a*, through which the contact rod 7 slides. Separation of contact parts 7A, 4A allows gas to enter volume V3 from V1, above piston 8 within cylinder 12.

The letters a and b denote the limits of travel of the end of the semi-fixed contact 4 and the letters a and c denote the limits of travel of the mobile contact 7.

Holes 16 in the terminal 2 enable unrestricted circulation of gas within the enclosure 1.

The operation of the circuit-breaker is as follows:

Interrupting Low Currents

Low currents are currents less than or equal to the nominal current of the circuit in which the circuit-breaker is included.

The mobile contact 7 is driven by the operating device; the semi-fixed contact 4, loaded by the spring 10, moves with the contact 7 as far as the position b; during this time the volume V1 is compressed adiabatically; at the start of this movement the piston 8 moves beyond the openings 13 with the result that there is no longer any communication between the volumes V1 and V2. When the end of the contact 4 reaches the position b the contacts 4 and 7 separate and an arc is struck; as soon as the end of the contact 7 has passed the neck of the nozzle 15 (position c) the gas from the volume V1 expands through the nozzle 15 and extinguishes the arc. The pressure increase due to the heating of the gas from the volume V1 is small, because the current to be interrupted is small, and its tendency to push back the piston 9 is counteracted by the action of the spring 10.

The small quantity of energy needed to extinguish the arc when interrupting a low current is provided by the compression of the gas in the volume V1 reduced to the minimum.

Interrupting Medium Currents

Medium currents are currents between the nominal current of the circuit and a specific threshold, for example five times the nominal current.

Operation is similar but when the contacts separate the arc intensity is such that the heating effect causes a pressure increase which pushes back the piston 8 against the action of the spring 10; however, as the current to be interrupted is only a medium current, this pressure increase is insufficient to push the piston beyond the openings 13, and the volume V1 remains isolated. The pressure rise in the volume V1 is nevertheless sufficient for interrupting medium currents.

Interrupting High Currents

High currents are currents above the previously mentioned threshold value.

Figure 2:
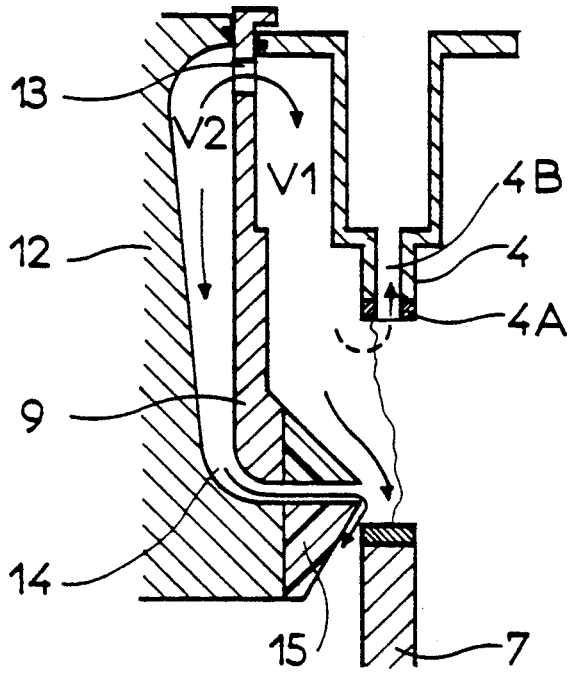
FIGS. 2 and 3 are diagrams explaining the functioning of the circuit-breaker from FIG. 1 when interrupting high currents.
Figure 3:
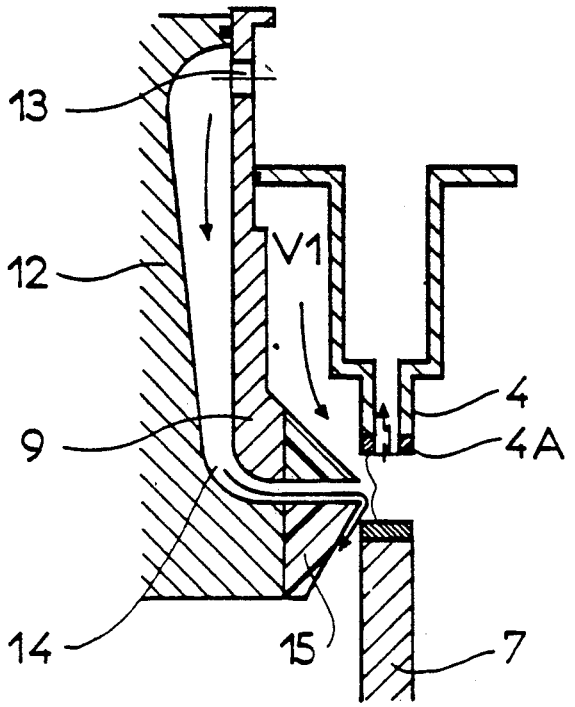

When the contacts separate the arc which is struck causes a pressure increase which pushes the piston 8 back beyond the openings 13 so that communication is established between the volumes V1 and V2. This limits the pressure rise to an acceptable value; when the current passes through zero, the gas pressure rise in the volume V1 extinguishes the arc through the passages 14, through the openings 13 and through the volume V1 if the piston 8 is still beyond the openings (FIG. 2) or through the volume V1 and the passages 14 if the piston 8 has moved below the openings 13 (FIG. 3). Note that by virtue of the presence of the passages 14 the gas blast, which is well centered by the nozzle 15, is directed very near the root of the arc, guaranteeing effective extinguishing of the arc.

It may be advantageous to provide an axial opening 4B in the contact 4 to direct the gas blast even closer to the other root of the arc and in the opposite direction to the effect of the other gas blast.

Figure 4:
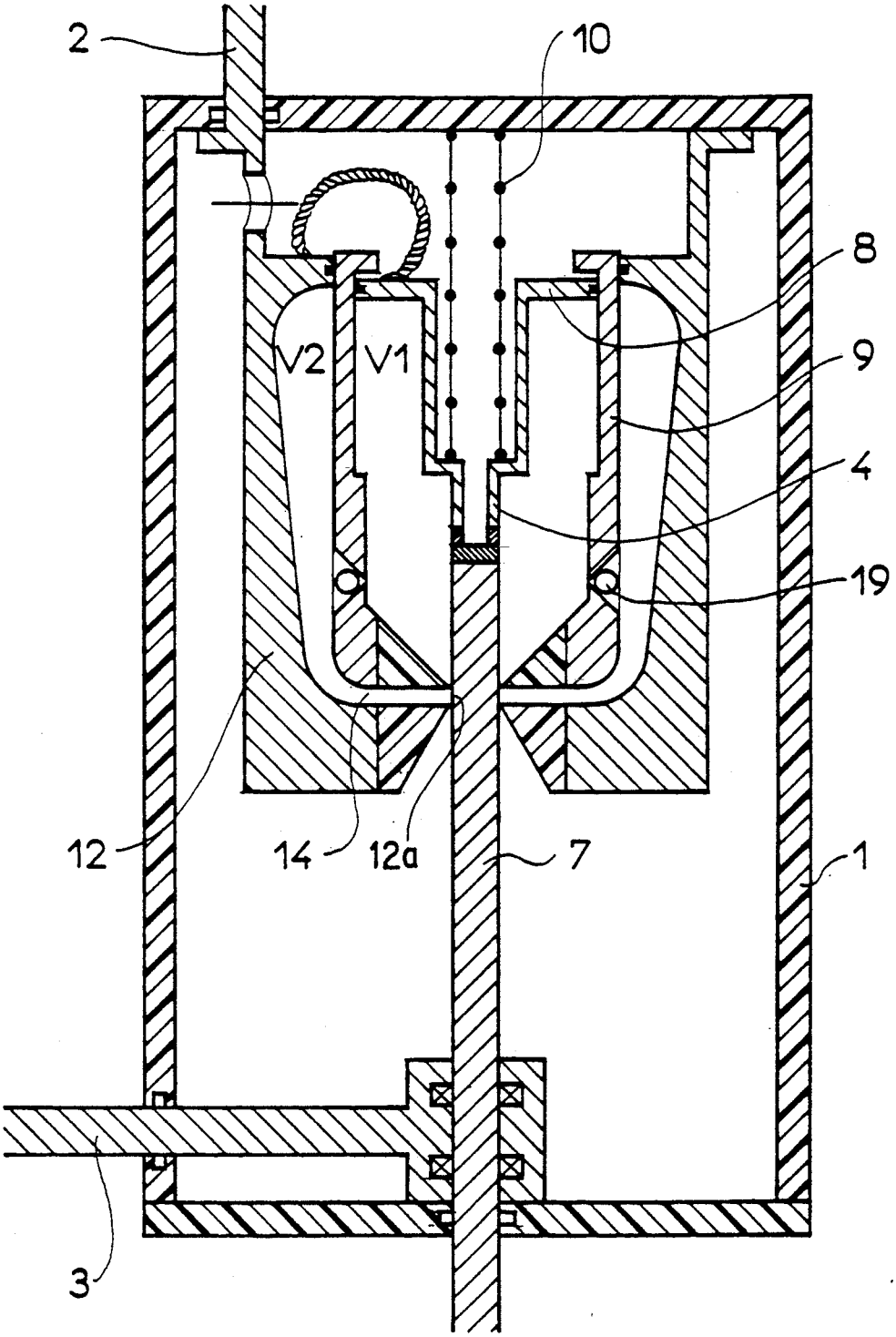
FIG. 4 is a partial schematic view in axial cross-section of a second embodiment of circuit-breaker in accordance with the invention.

FIG. 4 is a partial schematic view in axial cross-section of a second embodiment of circuit-breaker. Parts common to this figure and FIG. 1 have the same reference numbers. This embodiment differs from that of FIGS. 1 through 3 in that the openings 13 are dispensed with and replaced by check valves 19 which can open only in the direction from the volume V1 to the volume V2. These check valves are calibrated so as to open only if the pressure in the volume V1 reaches a specific threshold representing an arc caused by interrupting a high current. Operation is exactly the same for interrupting low and medium currents. When interrupting high currents the pressure rise in the volume V1 causes the valves 19 to open to establish communication between the volumes V1 and V2. The pressure in the volume V2 then rises and the arc is extinguished through the passages 14.

Figure 5:
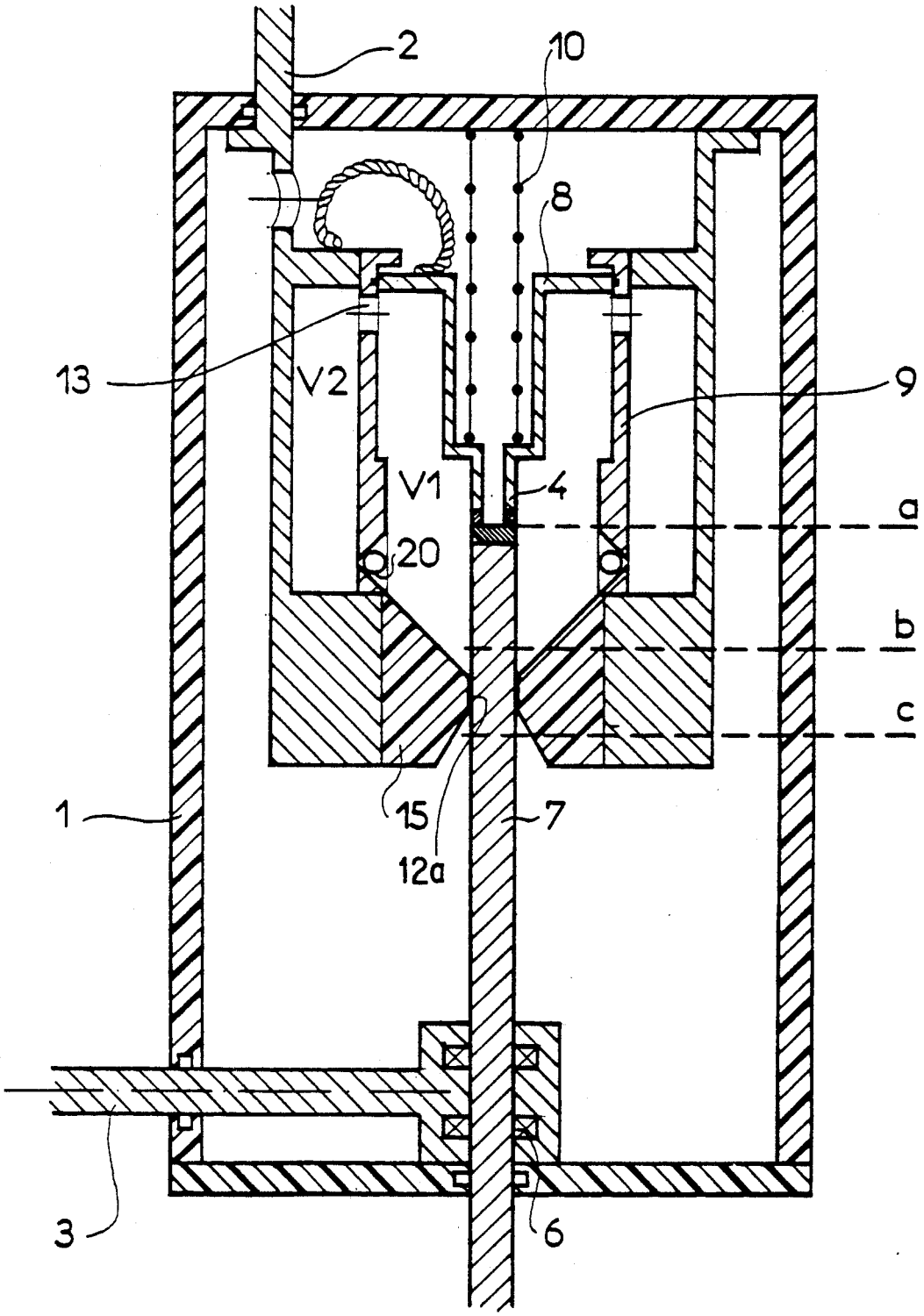
FIG. 5 is a partial schematic view in axial cross-section of a third embodiment of circuit-breaker in accordance with the invention.

FIG. 5 is a partial schematic view in axial cross-section of another embodiment of circuit-breaker. Parts common to this figure and FIG. 1 carry the same reference numbers.

In this embodiment communication between the volumes V1 and V2 is provided by the openings 13, as in FIG. 1, but the passages 14 are dispensed with and replaced by one or more one-way check valves 20 allowing gas to flow only from the volume V2 to the volume V1.

Operation to interrupt low and medium currents is the same as previously described.

Operation to interrupt high currents is as follows:

While the current is at a maximal value the pressure rise in the volume V1 lifts the contact 4 and the piston 8, which moves beyond the openings 13 and so establishes communication between the volumes V1 and V2. The pressure in the volume V1 is higher than that in the volume V2 at this time. The valves 20 are therefore closed.

Figure 6:
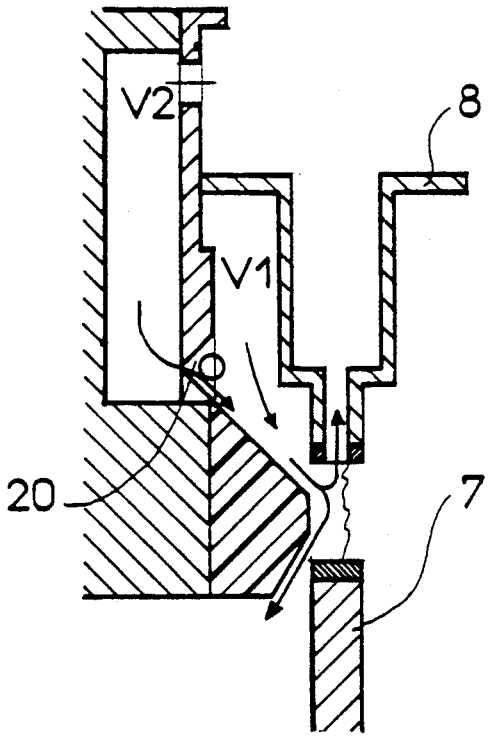
FIG. 6 is a diagram explaining the functioning of the circuit-breaker from FIG. 5.

As the current falls towards zero (the current is interrupted at the zero-crossing point), the pressure in the volume V1 falls which causes the piston 8 to move downwards and isolates the volume V2 from the volume V1. When the pressure in the volume V1 falls below that in the volume V2 the valves 20 open and gas from the volume V2 passes into the volume V1 and so contributes to extinguishing the arc (FIG. 6).

This embodiment has the advantage of enabling hot gas to circulate in the volume V2, entering through the openings 13 and leaving through the valves 20; this achieves improved regeneration of the dielectric properties of the gas.

Figure 7:
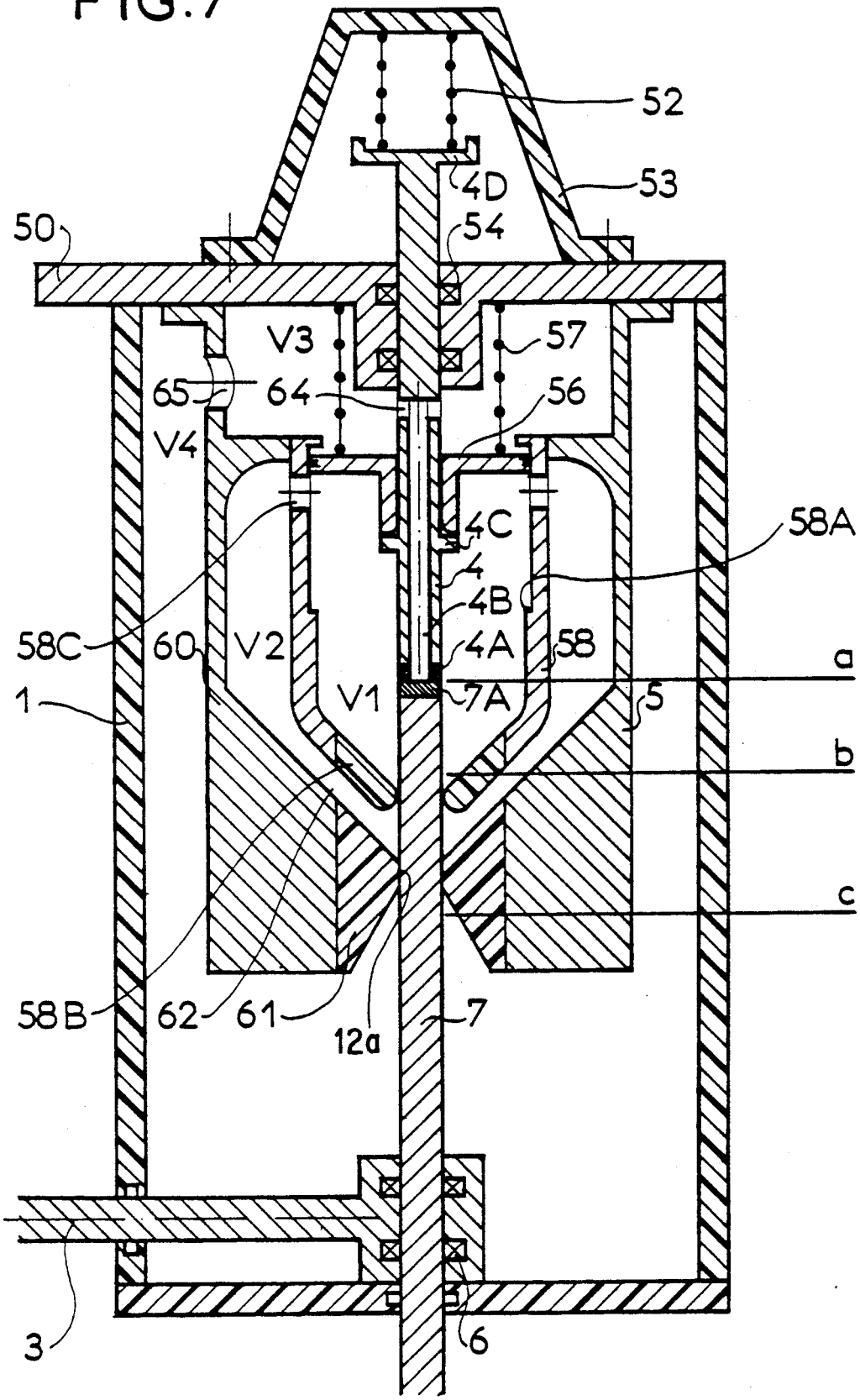
FIG. 7 is a partial schematic view in axial cross-section of a fourth embodiment of circuit-breaker in accordance with the invention.

FIG. 7 is a partial schematic view in axial cross-section of a further embodiment of the invention; once again, parts common to this figure and FIG. 1 carry the same reference numbers.

In this embodiment the enclosure 1 is closed at the top by a metal plate constituting the first terminal 50. The semi-fixed contact 4 extends outside the enclosure 1 and has an end 4D adapted to receive a spring 52 which bears against an insulative structure 53 at the top of the enclosure 1. Electrical contact between the rod 4 and the plate 50 is achieved by sliding contacts 54. The contact 4 includes a flange 4C against which the piston 56 abuts. The piston is no longer attached to the contact 4, but instead slides along it. A spring 57 bears against the plate 50 and pushes the piston 56 against the, flange 4C. The piston 56 slides in a cylinder 58 of volume V1 incorporating a shoulder 58A for limiting the travel of the piston 56. The end of the cylinder opposite the piston terminates in a conical portion 58B made from an insulative material and incorporating an orifice for the mobile contact 7 to pass through. The top of the cylinder 58 incorporates a plurality of openings 58C which, when the piston 56 is in the raised position, establishes communication between the volume V1 and a volume V2 defined by a cylinder 60 coaxial with the cylinder 58 and fixed to the plate 50. The cylinder 60 is closed at the bottom by an insulative nozzle 61 defining with the conical part 58B a passage 62 opening in the arc area.

The interior of the tube 4 communicates with the volume V3 above the piston 56 through holes 64; the volume V3 communicates with the volume V4 outside the cylinder 60 through holes 65. All these holes favor the circulation of the gas within the enclosure 1.

Figure 8:
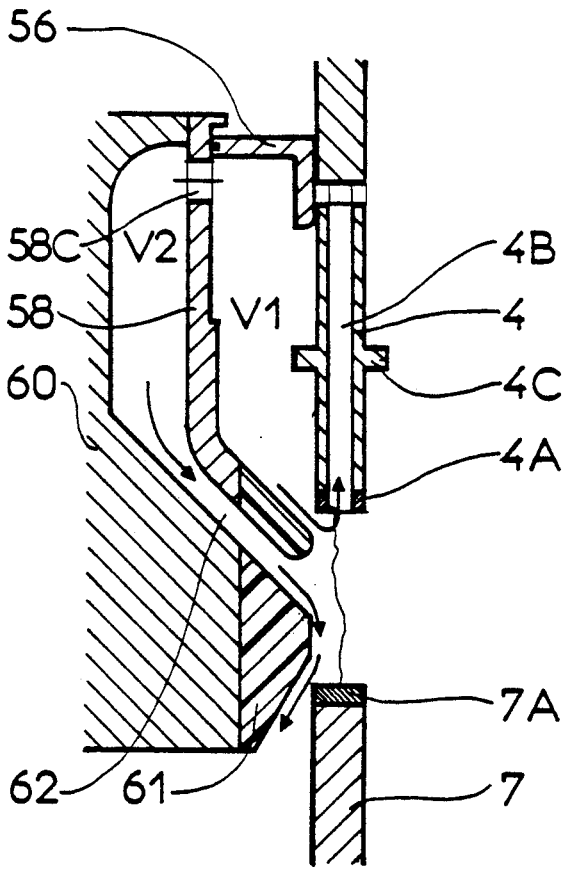
FIG. 8 is a diagram explaining the functioning of the circuit-breaker from FIG. 7.

The operation of the circuit-breaker, which is shown in the engaged (on) position in FIG. 6, is similar to that described with reference to FIG. 1, with one slight difference: when interrupting high currents the piston is raised by the increased pressure in the volume V1 until it passes beyond the openings 58C which establish communication between the volumes V1 and V2; however, and differing in this respect from the FIG. 1 device, the contact 4, being separate from the piston, continues to move due to the action of the spring 52 with the result that the gas blast is directed much closer to the roots of the arc, as shown in FIG. 8.

Figure 9:
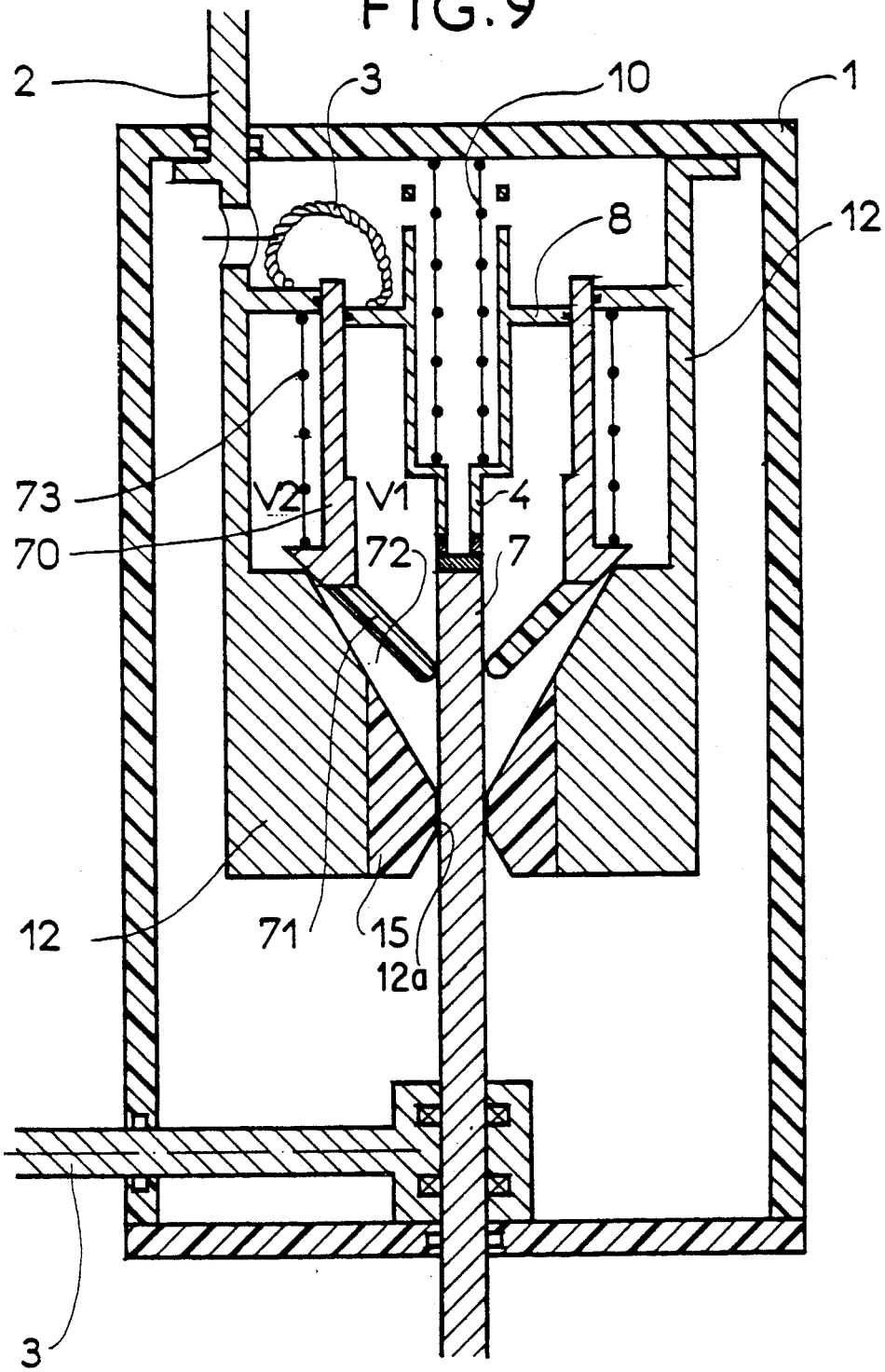
FIG. 9 is a partial schematic view in axial cross-section of a fifth embodiment of circuit-breaker in accordance with the invention.

The circuit-breaker in FIG. 9 differs from that in FIG. 1 in that the volumes V1 and V2 are separated by a jacket 70 that can slide in a sealed way between the piston 8 and the cylinder 12. The jacket is closed by a conical insulative material part 71 having an axial bore through which slides moving contact 7, closing off volume V1 and which with the nozzle 15 defines a passage 72. This passage is closed when the circuit-breaker is in the engaged (on) position, as shown in FIG. 8, by the action of a spring 73 which urges the jacket against a corner on the part 12.

The passage 72 remains closed when interrupting low and medium currents.

Figure 10:
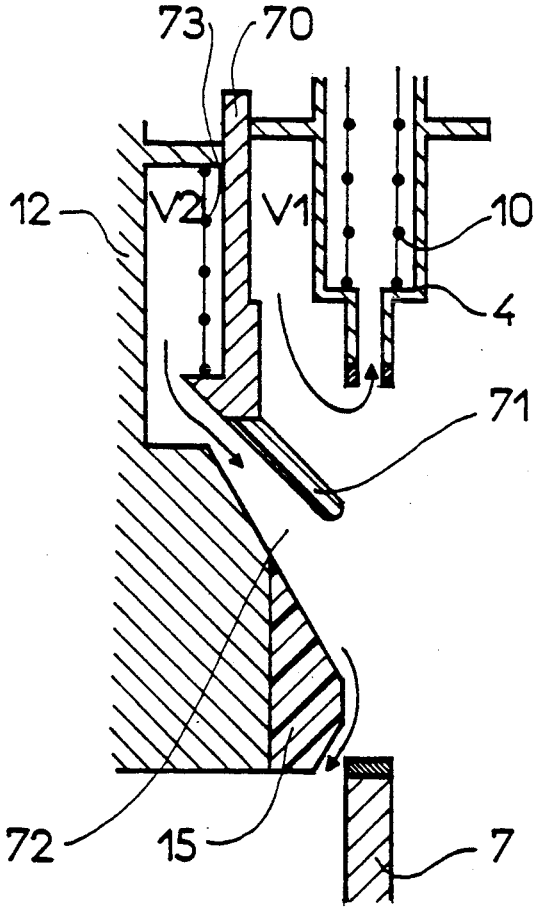
FIG. 10 is a diagram explaining the functioning of the circuit-breaker from FIG. 9.

When interrupting a high current the pressure rise in the volume V1 is such that it lifts the skirt 70, which adds the volume V2 to the volume of the interrupter chamber. When the current passes through zero the gas passes through the passage 72 (FIG. 10).

The invention, several embodiments of which have just been described, enables the volume of the interrupter chamber to be matched to the current to be interrupted more effectively. The gas blast is directed onto the roots of the arc, which ensures total effectiveness. The internal arrangement of the circuit-breaker (in the FIG. 1, 4, 5 and 7 embodiments) enables circulation of the gas whose dielectric properties are therefore regenerated quickly to achieve optimum extinguishing of the arc.

There is claimed:

1. Medium-voltage circuit-breaker comprising a sealed enclosure filled with a dielectric gas and containing a semi-fixed first contact electrically connected to a first terminal and a mobile second contact electrically connected to a second terminal and mechanically coupled to an operating member, said semi-fixed contact being operatively coupled with a piston movable in a first cylinder coaxially of said enclosure, interiorly thereof and spaced radially therefrom and constituting with said piston a first volume, said first cylinder being provided at one end with a nozzle having an axial bore and said mobile contact being insertable in said nozzle bore when said circuit-breaker is in the contacts engaged (on) position, a spring acting on said piston for urging said piston in the direction to decrease said first volume, said circuit-breaker comprising means for causing the gas to circulate automatically between said first volume and a second volume when the current to be interrupted reaches a predetermined threshold value, said first cylinder being surrounded by a second cylinder and defining with said first cylinder a second volume coaxial to said first volume and said means for causing gas to circulate automatically between said first volume and said second volume comprises at least one opening within said first cylinder communicating said first and second volumes and channels defined by said first and second cylinders communicating said second volume with the axial bore of said nozzle, and wherein the position of said at least one opening in said first cylinder is such that communication between said first and second volumes via said at least one opening is interrupted by movement of said piston in the direction of said mobile contact during a circuit-breaker operation switching off low currents, and said semi-fixed contact being a hollow tube and means for communicating the interior of said hollow tube with a third volume defined by said enclosure, said second cylinder and said piston.

2. Circuit-breaker according to claim 1 wherein said semi-fixed contact is fixedly attached to said piston.

3. Circuit-breaker according to claim 1, further comprising means for mounting said semi-fixed contact on said piston for movement thereof separate from that of said piston.

4. Circuit-breaker according to claim 1 wherein said second volume is associated with means for establishing communication of said second volume with the adjacent area of said nozzle.

5. Circuit-breaker according to claim 4 wherein said communication establishing means comprise aligned passages in the wall of said second cylinder and in said nozzle, open to said channels.

6. Circuit-breaker according to claim 4 wherein said communication establishing means comprise one-way check valves disposed between the first and second volumes in the vicinity of said nozzle.

7. Circuit-breaker according to claim 4 wherein said communication establishing means comprise a passage delimited by said nozzle and a conical part separating said first and second volumes.

8. Medium-voltage circuit-breaker comprising a sealed enclosure filled with a dielectric gas and containing a semi-fixed first contact electrically connected to a first terminal and a mobile second contact electrically connected to a second terminal and mechanically coupled to an operating member, said semi-fixed contact being operatively coupled with a piston movable in a first cylinder coaxially of said enclosure, interiorly thereof and spaced radially therefrom and constituting with said piston a first volume, said first cylinder being provided at one end with a nozzle having an axial bore and said mobile contact being insertable in said nozzle when said circuit-breaker is in the contacts engaged (on) position, a spring acting on said piston for urging said piston in the direction to decrease said first volume, said first cylinder being surrounded by a second cylinder and defining with said first cylinder a second volume concentric to said first volume, said circuit-breaker further comprising means for causing a gas to circulate automatically between said first volume and said second volume when the current to be interrupted reaches a predetermined threshold value, said first cylinder being provided with at least one opening communicating with first and second volumes and being located relative to said piston such that communication between said first and second volumes through said at least one opening is interrupted by movement of the piston during an operation of switching off low currents, and said semi-fixed contact being a hollow tube, and means for communicating the interior of said hollow tube with a third volume defined by said enclosure, said second cylinder and said piston.

9. Medium-voltage circuit-breaker comprising a sealed enclosure filled with a dielectric gas and containing a semi-fixed first contact electrically connected to a first terminal and a mobile second contact electrically connected to a second terminal and mechanically coupled to an operating member, said semi-fixed contact being operatively coupled with a piston movable in a first cylinder coaxially of said enclosure, interiorly thereof and spaced radially therefrom and constituting with said piston a first volume, said first cylinder being provided at one end with a nozzle having an axial bore and said mobile contact being insertable in said nozzle when said circuit-breaker is in the contacts engaged (on) position, a spring acting on said piston for urging said piston in the direction to decrease said first volume, said first cylinder being surrounded by a second cylinder and defining with said first cylinder a second volume concentric to said first volume, said circuit-breaker further comprising means for causing the gas to circulate automatically between said first volume and said second volume when the current to be interrupted reaches a predetermined threshold value and wherein said gas circulation means comprises check valves disposed in said first cylinder for discharge into said second volume, said check valves opening only in a direction from said first cylinder towards said second volume and being calibrated to open only if the pressure in the first cylinder reaches a predetermined threshold representing an arc caused by interrupting a high current, and passages communicating said second volume with the axial bore of said nozzle.

10. Medium-voltage circuit-breaker comprising a sealed enclosure filled with a dielectric gas and containing a semi-fixed first contact electrically connected to a first terminal and a mobile second contact electrically connected to a second terminal and mechanically coupled to an operating member movable axially within said sealed enclosure, first and second concentric cylinders positioned internally of said sealed enclosure, said first cylinder comprising an axially movable jacket, means for mounting said jacket for limited axial movement relative to said second cylinder, said second cylinder being fixed to said enclosure and terminating at one end in a nozzle slidably carrying said mobile contact, said semi-fixed contact being operatively coupled with a piston movable axially in said first cylinder and defining with said piston a first volume, said second cylinder defining with said first cylinder a second volume concentric to said first volume, a first spring interposed between said jacket and said second cylinder for biasing said jacket into second volume closed condition, such that said bias of said first spring causes a gas to circulate automatically between said first volume and said second volume when the current to be interrupted reaches a predetermined threshold value, a second spring interposed between said enclosure and said piston for urging the piston in the direction to decrease said first volume, and said semi-fixed contact being a hollow tube and means for communicating the interior of said hollow tube with a third volume defined by said enclosure, said second cylinder and said piston.

11. Circuit-breaker according to claim 10 wherein said communication establishing means further comprise a passage delimited by said nozzle and a conical part fixed to said jacket at an end thereof proximate to said nozzle and said conical part has an axial bore coaxial with said nozzle through which said mobile contact passes during closure of said mobile contact and said semi-fixed first contact.

* * * * *